United States Patent [19]

Su

[11] Patent Number: 4,771,976

[45] Date of Patent: Sep. 20, 1988

[54] EXTENDABLE BOOK PROP

[76] Inventor: Cheng-Cheng Su, No.23, Sec.2, Minchuan Road, Tainan, Taiwan

[21] Appl. No.: 73,973

[22] Filed: Jul. 15, 1987

[51] Int. Cl.[4] ..... A47B 97/04

[52] U.S. Cl. ..... 248/448; 248/461; 248/456; 248/172; 108/102

[58] Field of Search ..... 248/448, 461, 456, 457, 248/465, 172, 173, 149, 449, 460, 359 C; 108/90, 102, 5; 211/43, 175

[56] References Cited

U.S. PATENT DOCUMENTS

| | | | |
|---|---|---|---|
| 1,515,058 | 11/1924 | Lindhe | 211/175 X |
| 1,542,495 | 6/1925 | Ebert | 211/175 X |
| 1,554,979 | 9/1925 | Dugan | 248/448 |
| 1,602,338 | 10/1926 | Chittenden | 248/448 |
| 2,003,746 | 6/1935 | Headington | 248/456 X |
| 2,027,928 | 1/1936 | Norwood | 248/448 |
| 2,489,553 | 11/1949 | Wofford | 248/449 X |
| 2,501,019 | 3/1950 | Attick | 248/448 |
| 4,470,571 | 9/1984 | Hartman | 248/453 X |
| 4,555,128 | 11/1985 | White et al. | 248/456 X |
| 4,618,119 | 10/1986 | Powell | 248/456 |

*Primary Examiner*—Ramon S. Britts
*Assistant Examiner*—Karen J. Chotkowski
*Attorney, Agent, or Firm*—Poms, Smith, Lande & Rose

[57] ABSTRACT

A main plate having a bookstop on its lower end and having a cavity on its inside. The cavity slidably retains two slide plates which are extendable from its lateral sides and one top plate which is extendable from its top. The top plate itself also has two slide plates which are extendable from its lateral sides when the top plate and the slide plates are extended. A support rod is adjustable in a multiplicity of grooves on the base plate and also adjustable on the back of the main plate for allowing a wide range of reading angles and support stability.

1 Claim, 14 Drawing Sheets

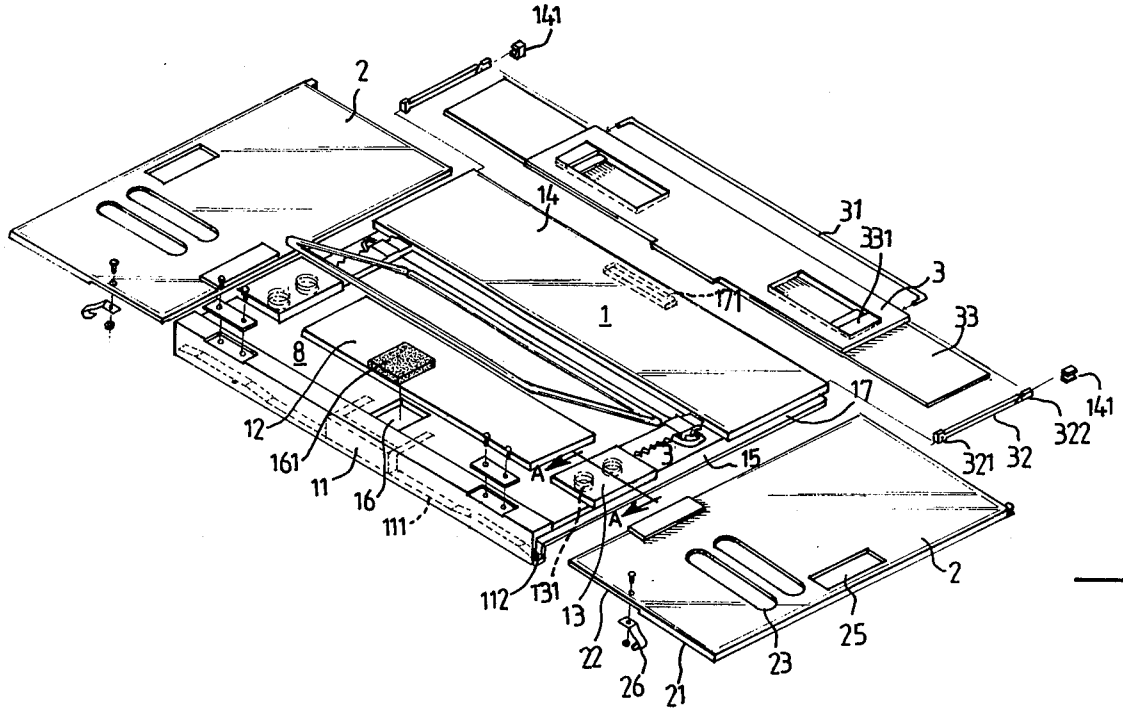
FIG. 2-A

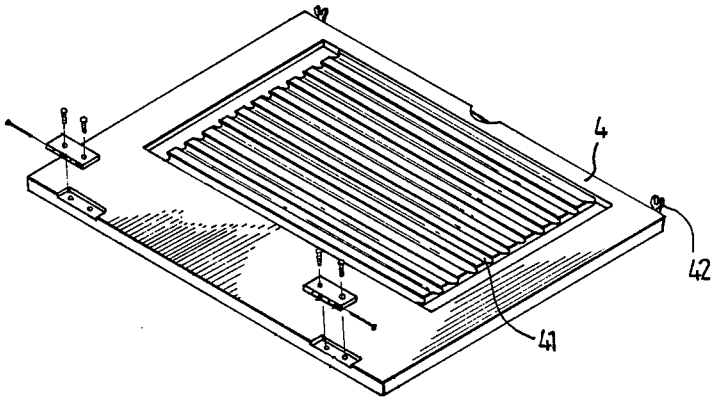
FIG. 2-B

FIG. 5-A
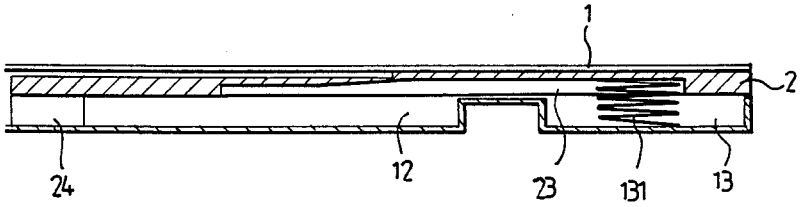
FIG. 5-B
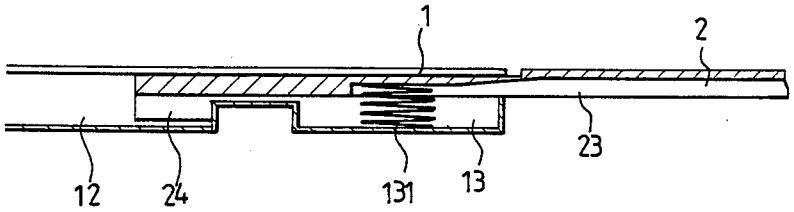
FIG. 5-C
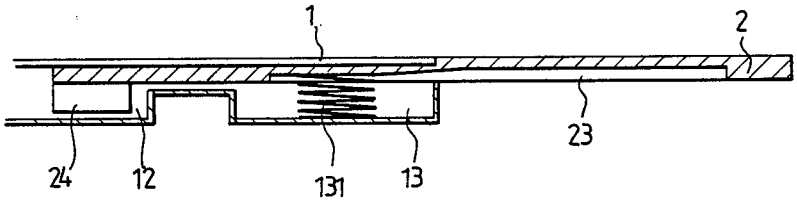

FIG. 6-A
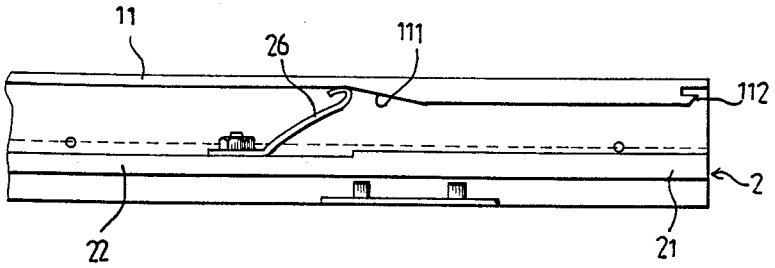
FIG. 6-B
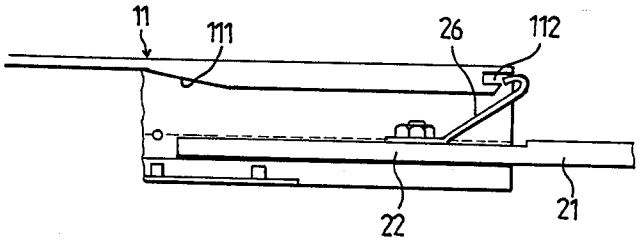
FIG. 6-C
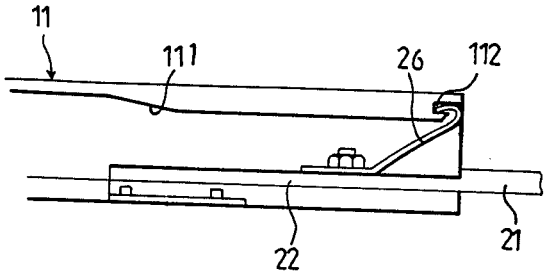

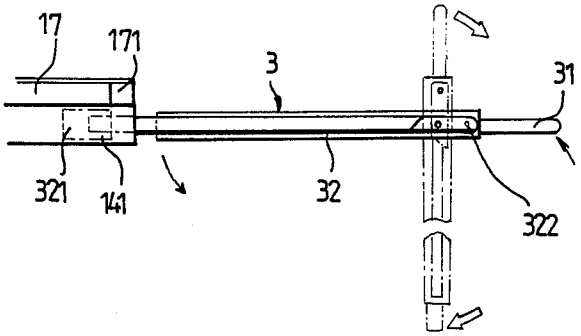
FIG. 8-A
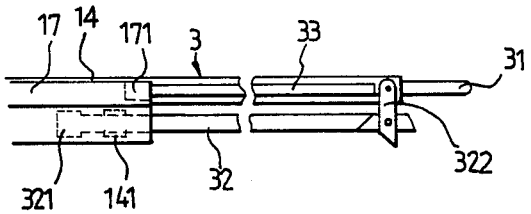
FIG. 8-B

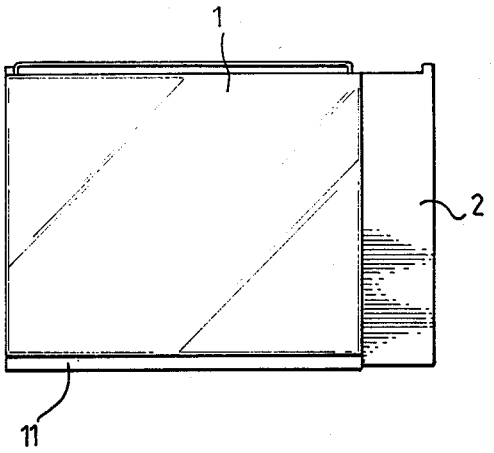
FIG. 9-A
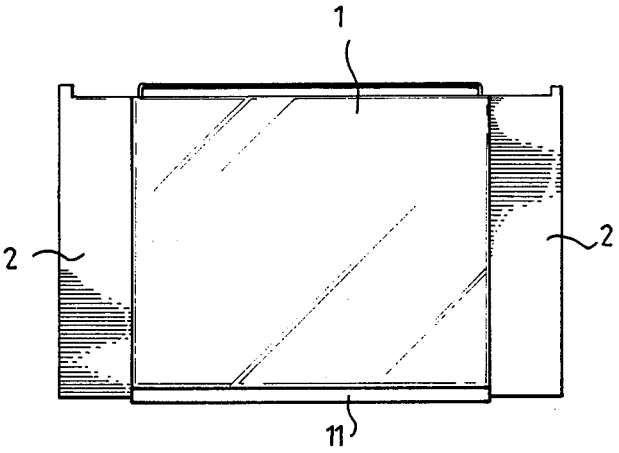
FIG. 9-B

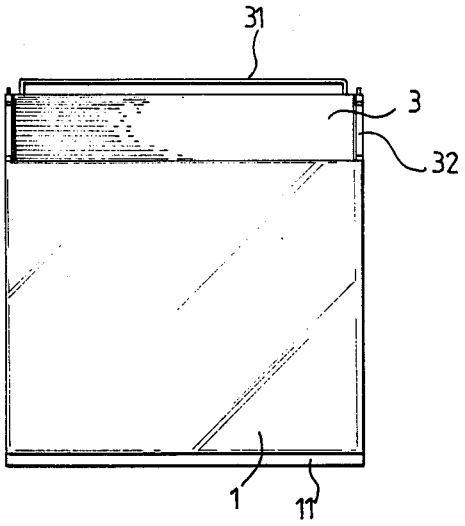
FIG. 9-C
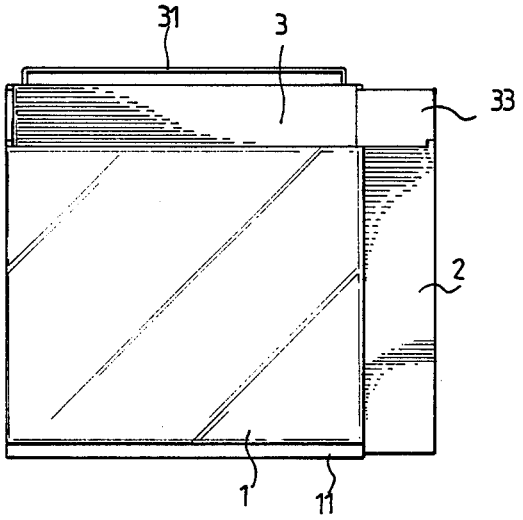
FIG. 9-D

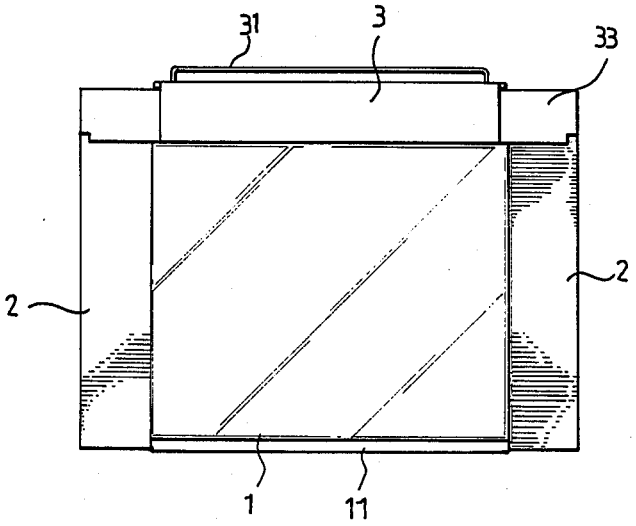
FIG. 9-E

EXTENDABLE BOOK PROP

BACKGROUND OF THE INVENTION

This invention relates to book props, and in particular relates to a book prop with extendable sides for different sized reading material.

In the past, book props were available, but they were not adjustable for different sizes of reading material. The reader was forced to try to adapt his reading material to the size of his prop, which was often inconvenient or impossible. One solution to this problem would be to buy or manufacture a large prop, but of course this would create the problem of storing and carrying a bulky reading prop.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a reading material prop which has sides which are extendable from the top and the sides.

Another objective of this invention is to provide a reading material prop which is angularly adjustable from both ends thereof.

A further objective of this invention is to provide a reading material prop which can be closed and "locked" in place when not in use.

Further objectives and advantages of the present invention will become apparent as the following description proceeds, and the features of novelty which characterize the invention are pointed out with particularity in the claims annexed to and forming a part of this invention.

BRIEF DESCRIPTION OF THE DRAWINGS

FIG. 2-A is an exploded view showing the back side of a book prop in accordance with the present invention;

FIG. 2-B is a perspective view of a base plate in accordance with the present invention;

FIGS. 5-A, 5-B, and 5-C are views taken along line A—A of FIG. 2-A showing the operation of the slide plate 2;

FIGS. 6-A, 6-B, and 6-C are views showing the operation of the hook along the track which is on the inside of the bookstop;

FIGS. 8-A and 8-B show the use of the extension arm;

FIGS. 9-A, 9-B, 9-C, 9-D and 9-E show several views of a reading prop in various extended positions;

DETAILED DESCRIPTION OF THE PREFERRED EMBODIMENT

Figure 1:
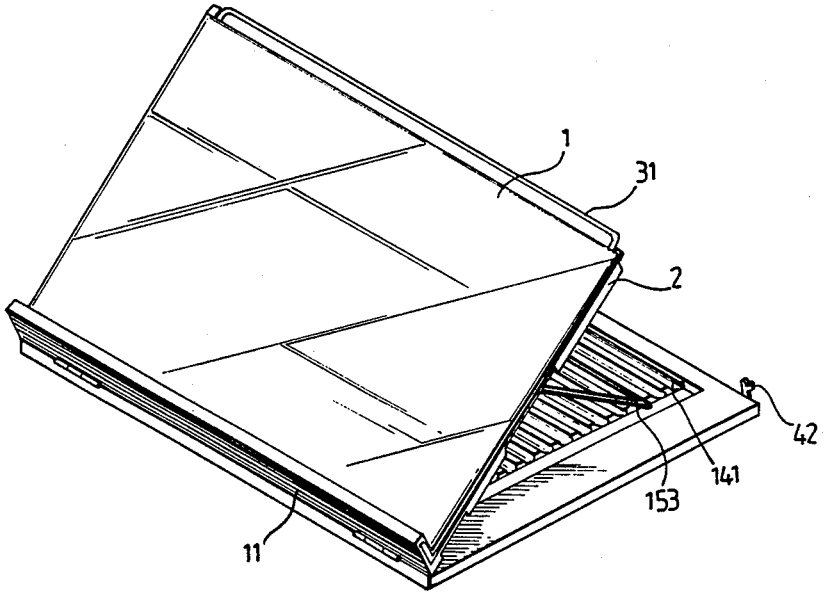
FIG. 1 is a perspective view of a book prop in accordance with the present invention in unextended position.

Referring to FIG. 1, it can be seen that the present invention comprises a main plate 1, slide plates 2, a base plate 4 and a support rod 153. Of course, the base plate 4 has grooves on the upper surface thereof for receiving the support rod to adjust the angle of the main plate 1.

FIG. 2-A shows that the two slide plates 2 fit into the cavity 17 between the top plate 15 and the bottom plate 14. These plates 2 are guided and retained by springs 131 and extension slots 23. The springs 131 themselves are set on the top and bottom walls of a rectangular cavity 13. A long retainer block 24, which is slidably retained by rectangular recess 12 prevents the slide plate 2 from being pulled completely out of the cavity 17. The slide plates 2 may be pulled out by their respective pull recesses 25. The top plate 3 has upper slide plates 33 which are slidably retained therein by short retainer blocks 331 and matching rectangular cavities.

Referring to FIGS. 1 and 2-B, the base plate 4 can be clearly seen. This base plate 4 has a plurality of grooves 41 thereon which allow for the adjustment of the support rod 153, which varies the angle of the main plate 1 (or the reading angle).

Figure 3:
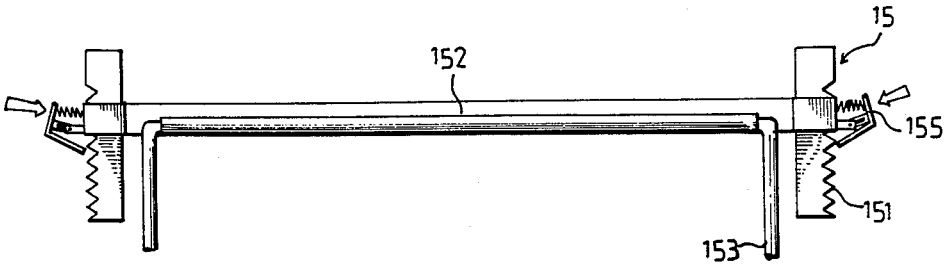
FIG. 3 is an elevational view of the upper adjustable section of the support rod in accordance with the present invention.
Figure 4:
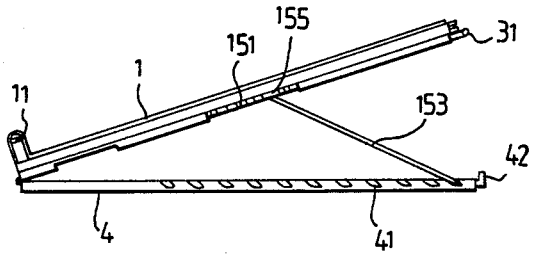
FIG. 4 is a side view showing the duel adjustability feature of a support rod in accordance with the present invention.

From FIGS. 3 and 4, it can be seen that the present invention provides two methods for adjusting the support rod 153. The most obvious method for adjusting the inclination is to change the position of the support rod 153 in the grooves 41. As the lower end of the support rod 153 is moved towards the front or the base plate 4, the main plate 1 moves upwards and vice-versa. An inner adjustment rack 15 set on the back of the main plate 1 is another means for adjusting the inclination of the main plate 1. This extra means allows the main plate 1 to be inclined at a greater range of angles than was previously possible. For instance, if the lower end of the support rod 153 is placed in the outermost (rightmost) groove 41', the spring-loaded levers may be pressed in so as to allow the pivotal retainer sleeve 152 to be slid to its lowest position, thereby further lowering the main plate 1. However, if stable support is needed, say for larger books, then the pivot retainer sleeve 152 can be slid to the highest of the support rod adjustment notches 151, thereby providing better leverage and hence more stability.

Referring to FIGS. 5-A thru 5-C and FIG. 2-A, the operation of the extension slots 23 and the springs 131, as seen along line A—A of FIG. 2-A can be seen. Please note that FIGS. 5-A thru 5-C and 6-A thru 6-C are all "upside-down" with respect to FIG. 2-A. FIG. 5-A shows the slide plate 2 in retracted or unextended position. As the slide plate 2 is pulled out from the cavity 17 (see FIG. 2A), it is retained by long retainer block 24 against the wall of the rectangular recess 12. Note that the extension slots 23 have a spring 131 therein which urge the slide plate 2 upwards once it has been extended outwards, as shown in FIG. 5-B, so that the level of the slide plate 2 and the level of the main 1 are the same. In FIG. 5-C, the slide plate 2 is shown after it is pushed to be flush against the main plate 1.

Now turning to FIGS. 6-A thru 6-C, the operation of the stabilizing hook 26 of the slide plate 2 can be seen.

Before extension, the hook 26 fits inside a "track" which is actually the shaped wall of the bookstop 11. As the slide plate 2 is extended, the hook eventually comes out of the track, as shown in FIG. 6-B. At this point the slide plate 2 is extended as possible. Because there is no pressure on the hook 26, it protrudes at a greater angle than when it is retained. The user now pushes the slide plate 2 back towards the cavity 17, so that the hook 26 engages in the hook catch 112. With one slide plate 2 extended, the book prop according to the present invention can be seen. Depending on the width of the book or reading material, it may be necessary to extend both side plates 2, as shown in FIG. 9-B.

Figure 7:
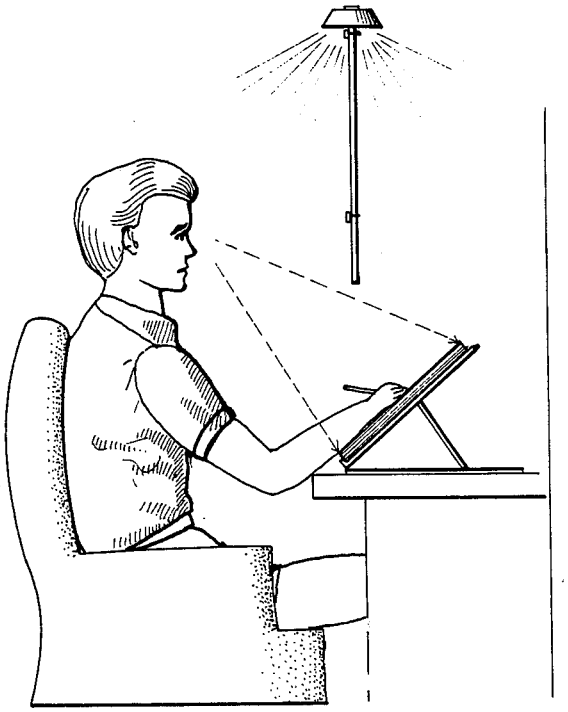
FIG. 7 is a working view of the present invention, as seen from the side.

FIG. 7 shows a working view of the present invention, as seen from the side. Regardless of the size of the reading material used, the user can always read (or write) at the optimal angle.

From FIGS. 8-A and 8-B, the operation of the top plate 3 can be understood. In normal conditions, the top plate 3 is tucked inside of the main plate 1, but if an especially long book or document is being used, then it is necessary for the top plate 3 to be extended. To extend the top plate 3, the user simply pulls on the extension rod 31 until the knob 321 of the extension arm 32 is fully extended. Then the upper top plate 3 is turned clockwise 90 degrees so that the pivot piece 322 is turned to a vertical orientation. Then the top plate 3 is rotated counterclockwise 90 degrees about an upper pivot 322. Finally, the extension arm 32 and the upper slide plate 33 are pushed in so that the end of the upper slide plate 33 fits into a securement cavity 171. At this point, the top surface of the upper slide plate 33 and the upper surface of the main plate 1 are at the same level so as to be flush with each other.

After the top plate 3 has been extended, upper slide plates 33 therein can also be extended, so as to form the different views shown in FIGS. 9-C, 9-D, and 9-E.

Figure 10:
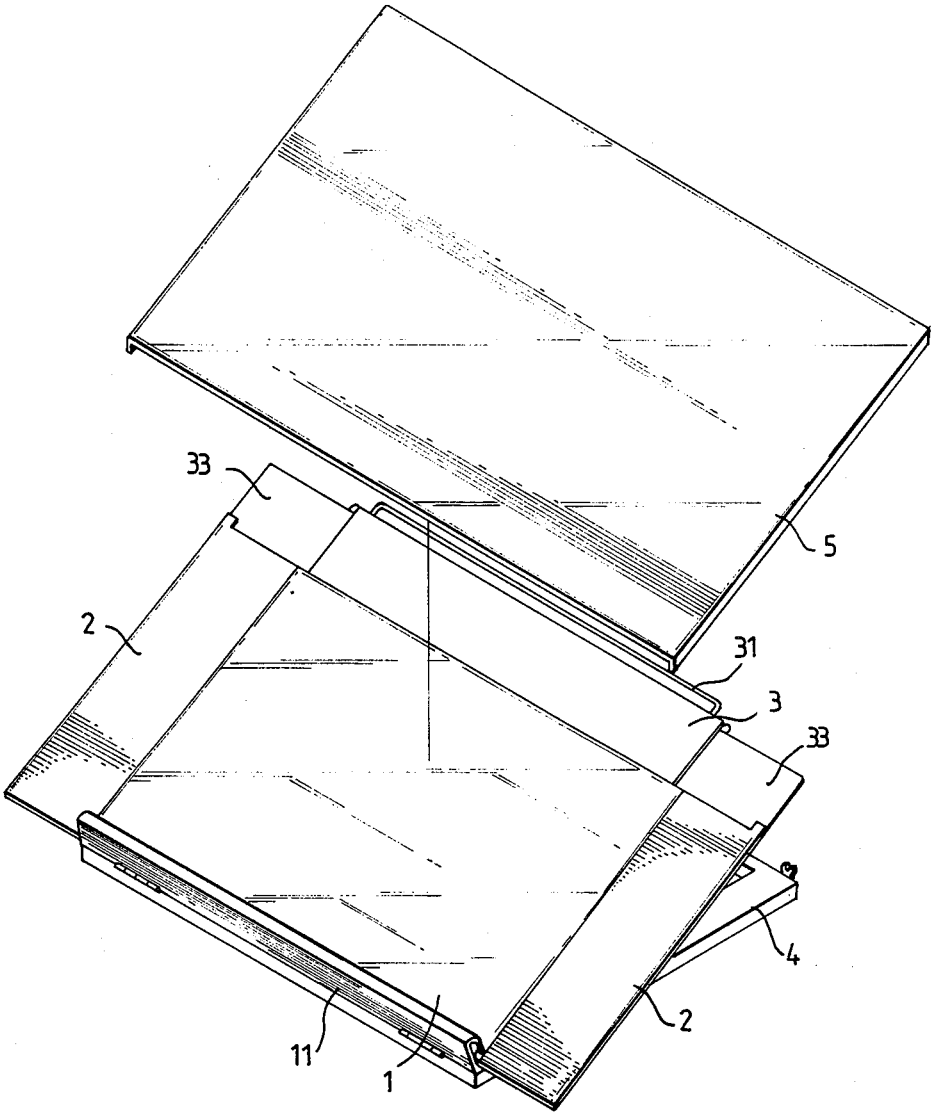
FIG. 10 shows the reading prop of the present invention in fully extended position and shows how a writing cover can be placed on the top surface thereof if desired.
Figure 11:
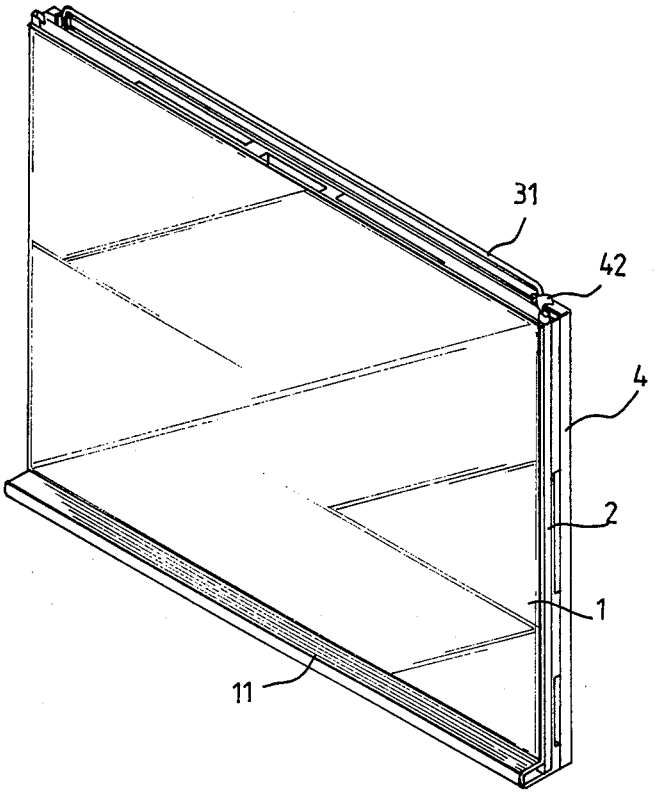
FIG. 11 shows the reading prop of the present invention is closed position.
Figure 12:
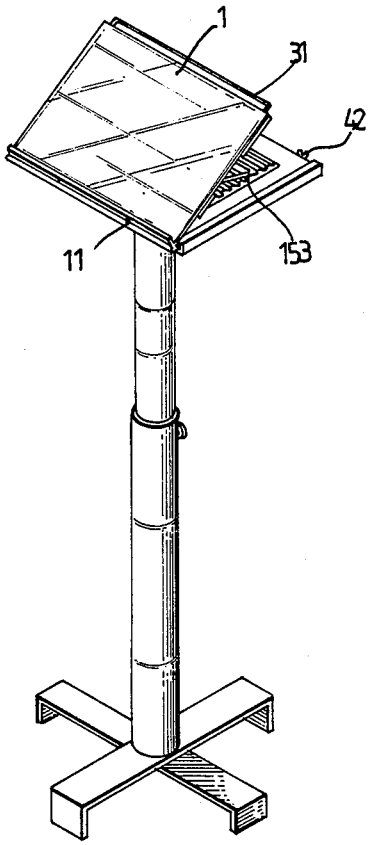
FIG. 12 shows a working view of the present invention used in conjuction with a stand to form a music stand.

FIGS. 10, 11 and 12 show several other features which can be applied to this invention. For example, in FIG. 10, it can be seen that if it is desired to use the present invention as a writing surface that a cover plate 5 can be used to insure even smoother writing than would be otherwise possible due to the edges of the main, side and top plates 1, 2, and 3, respectively. Another nice feature of the present invention is that it can be snapped close by means of catch 42, which engages with the vertical portion of the extension rod 31, as shown in FIG. 11. Finally, this invention could be used in conjunction with some type of stand, as shown in FIG. 12, as the situation might require.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. An extensible book prop comprising:

(A) a main plate (1) having a book holding means and a central cavity (17);

(B) two slide plates (2) being laterally extensible from the lateral sides of said main plate (1);

(C) a top plate (3) being extensible from the top side of said main plate (1) from said central cavity (17); said top plate (3) having an extension rod (31) set on the top end thereof for gripping said top plate (3); said top plate also having upper side plates (33) being extensible from the lateral sides of said top plate;

(D) a base plate (4) pivotally attached to said main plate and having a multiplicity of grooves (41) on the top surface thereof; said base plate (4) also having a catch (42) on two corners thereof for engaging said extension rod; and (E) a support rod (153) which is pivotally mounted on the bottom surface of the main plate (1); said support rod (153) being movable for engaging any of said multiplicity of grooves (41) to support said main plate (1) at an angle.

* * * * *